US007020934B2

(12) United States Patent
Tashiro

(10) Patent No.: US 7,020,934 B2
(45) Date of Patent: Apr. 4, 2006

(54) PUSH TYPE FITTINGS

(75) Inventor: Akira Tashiro, Uozushi (JP)

(73) Assignee: Kabushiki Kaisha Kuwayama, Tokyo (JP)

( * ) Notice: Subject to any disclaimer, the term of this patent is extended or adjusted under 35 U.S.C. 154(b) by 99 days.

(21) Appl. No.: 10/828,810

(22) Filed: Apr. 21, 2004

(65) Prior Publication Data

US 2005/0155383 A1 Jul. 21, 2005

(30) Foreign Application Priority Data

Jan. 20, 2004 (JP) ..... 2004-012274

(51) Int. Cl.
*A43C 7/08* (2006.01)
*A44B 21/00* (2006.01)

(52) U.S. Cl. ..... 24/115 G; 24/116 R; 24/136 R; 24/115 M; 24/115 H; 24/712.1; 59/93; 439/818

(58) Field of Classification Search ..... 439/817, 439/818; 24/136 R, 136 K, 136 I, 115 G, 24/115 M, 115 H, 115 K, 712.1, 712.2, 712.3, 24/712.5, 116 R, 116 A; 36/50.1; 59/93; 339/254 R See application file for complete search history.

(56) References Cited

U.S. PATENT DOCUMENTS 5,315,741 A * 5/1994 Dubberke ..... 24/712.1

* cited by examiner

*Primary Examiner*—Jack W. Lavinder
(74) *Attorney, Agent, or Firm*—Greer, Burns & Crain, Ltd.

(57) ABSTRACT

In push type fittings capable of timely changing a length of a loop such as a necklace, a bracelet and the like, the aforesaid push type fitting, includes a hollow outer body which is formed to have an aperture portion at an upper end and a pair of insertion holes opposing each other in side surfaces perpendicular to the aperture, for passing a chain there through; a cylindrical sliding body which is formed to be tightly closed at one end with an aperture at the other end and to have a pair of through holes in side surfaces perpendicular to the aperture opposing each other for passing the chain there through; a ring body forming an approximately rectangular or circular ring shape and having a penetrated aperture portion for passing the chain there through; and a coil spring for biasing the sliding body and the aforesaid ring body in a direction to catch the chain. The push type fittings is provided at low cost, is easy to assemble without making an outer shape large, is favorable in operability, and is easy to repair.

4 Claims, 8 Drawing Sheets

PUSH TYPE FITTINGS

FIELD OF THE INVENTION

The present invention relates to push type fittings capable of freely changing the length of a chain ring such as a necklace or bracelet.

BACKGROUND OF THE INVENTION

A fixture fitting functions to freely change the length of a chain loop such as a necklace. The terms "chain" or "chain loop" are used herein broadly to refer to any thin flexible member that may be connected to its self to form a loop or ring. The fitting comprises an upper lid, a lower lid and a spring. The spring and the lower lid are housed into the upper lid. The upper lid and the lower lid are nipped between a person's fingers to compress the spring, the lower lid is moved downward, then the chain is inserted into a chain passing hole in the lower lid from a chain passing hole in the upper lid. On releasing fingers, the lower lid is biased in the nipping direction by the spring, and the chain passing hole of the upper lid and the chain passing hole of the lower lid sandwich the chain to fix the chain. See, for example, Japanese Utility Model No. 3089926.

There are other fittings which have a hollow housing including a pair of aperture portions, through which a chain or the like is inserted, on a side surface, an insert body built inside the housing slideably to abut to the chain inserted through the above described aperture portions with a head portion being held retractably on an interior surface of the hollow housing, and a spring for biasing the insert body in a direction to abut to the chain. These fittings are capable of freely changing the length of the chain ring. See for example, Japanese Patent Laid-open No. 2001-219.

There are fixture fittings capable of freely changing the length of a chain loop by providing opposing holes in a hollow outer body, into which is inserted an elastic body constructed of rubber, silicon rubber or the like having a through hole portion therein. By inserting a chain through the outer body and the elastic body, frictional resistance of the elastic body causes the chain to stop at an optional position. See for example, Japanese Patent No. 2971453.

However, the fittings disclosed in Japanese Utility Model No. 3089926 have structure for pressing the chain with the sidewalls of the upper lid and the lower lid. The fittings enclosed in Japanese Patent Laid-open No. 2001-219 have the disadvantage that the chain will bend at the aperture portions in the hollow housing when the chain is slid, because a pair of aperture portions included on the side surface of the hollow housing do not oppose each other due to the insert body, and since the chain slides in contact with the aperture portions, the chain doesn't move smoothly. The fitting disclosed in Japanese Patent No. 2971453 is used by sliding them frequently, the chain and the elastic body such as rubber, silicon rubber or the like will deteriorate due to abrasion, and in such a case it is difficult to repair them.

SUMMARY OF THE INVENTION

An object of the present invention is to provide push type fittings at low cost, which are easy to assemble without making an outer shape large, excellent in operability, and easy to repair.

The push type fitting of the present invention is characterized by being constructed of a hollow outer body having an aperture at an upper portion, and a pair of penetrated insertion holes opposing each other for passing a chain there through on side surfaces perpendicular to the aforesaid aperture, and having a ring adapted for connection to a clasp; a cylindrical metal sliding body which is formed to be tightly closed at one end with an aperture at the other end, and with a pair of through holes opposing each other for passing the chain there through being formed on side surfaces perpendicular to the aperture; a ring body forming an approximately rectangular or circular ring shape, and having a penetrated aperture for passing the chain there through; and a coil spring for biasing the insertion holes of the sliding body and the aperture of the aforesaid ring body in a direction to catch the chain. The push type fitting is characterized in that the coil spring and the ring body are placed in this order inside the sliding body, and the sliding body is inserted from the aperture of the outer body to construct the push type fitting. The push type fitting is held nipped between a thumb and an index finger. By pressing the sliding body with the index finger, the insertion holes of the outer body and the through holes of the sliding body are aligned with the aperture of the ring body. One end of the chain is inserted through the insertion holes of the outer body, the through holes of the sliding body, and the aperture portion of the ring body. When the index finger is removed from the sliding body it is released; thereby the sliding body is pushed outward by the coil spring; then the sliding body through holes and the ring body aperture are misaligned; and the through holes of the sliding body and the inner surface portion plane of the aperture of the ring body catch the chain, whereby the necklace chain can be stopped at an optional position.

The outer body of the push type fitting of the present invention is characterized by being replaceable with outer bodies having a changed shape, or having a pattern on its surface, or having a different color from the chain.

From the above described construction, the push type fitting of the present invention is easy to assemble, and since the insertion holes of the sliding body, and the inner surface portion plane of the aperture of the ring body catch the chain, the chain can be reliably held and stopped, thus obtaining stable operability. If repair is required, replacement of the components is easy. Products at low cost can be provided by forming the components by pressing.

DETAILED DESCRIPTION OF THE PREFERRED EMBODIMENT

The object is achieved by the push type fitting of the invention that provides easy assembly and favorable operability is realized without making the outer shape large and without spoiling its beauty.

Figure 1:
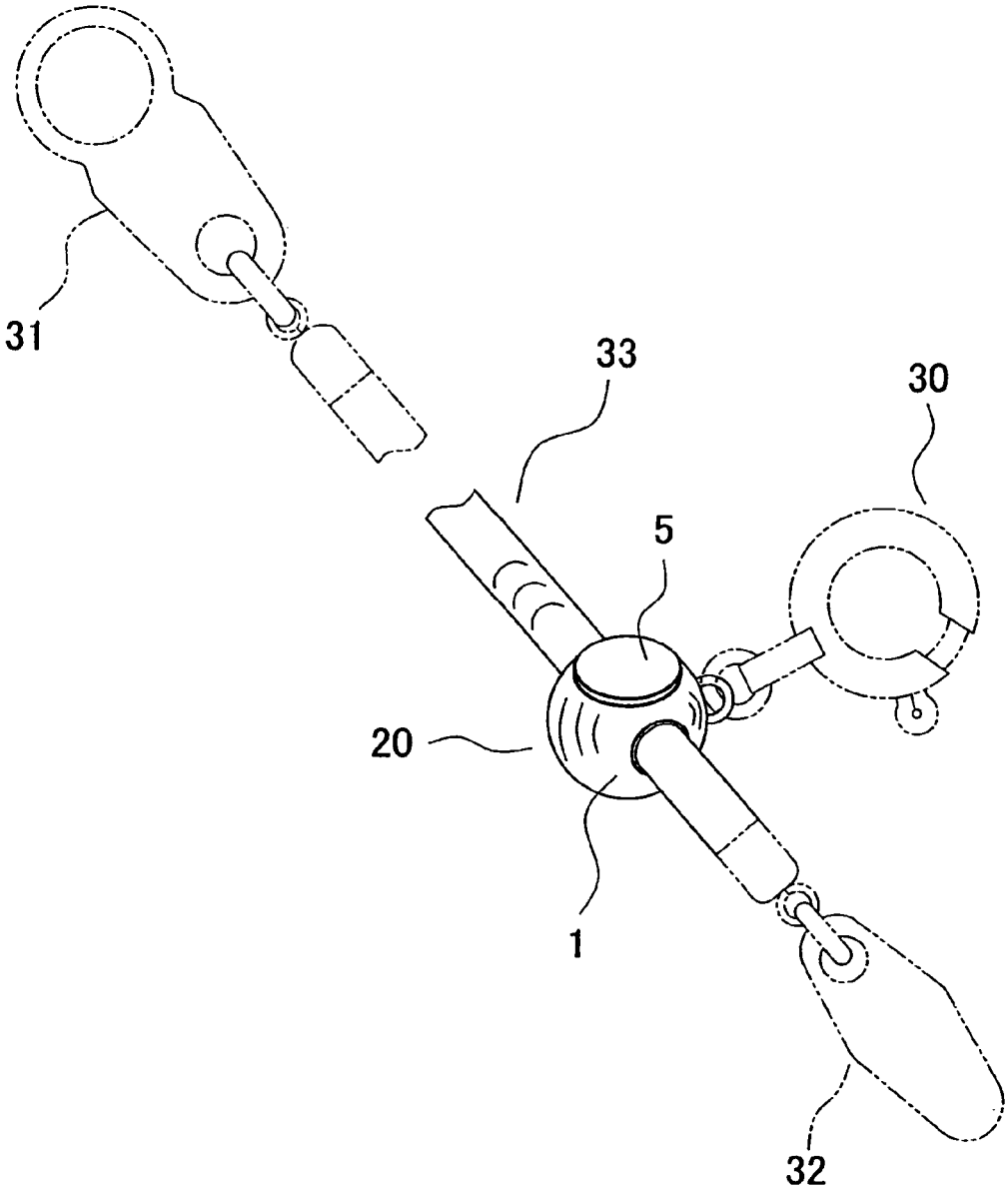
FIG. 1 is a perspective view showing a use of a push type fitting of the present invention.
Figure 3:
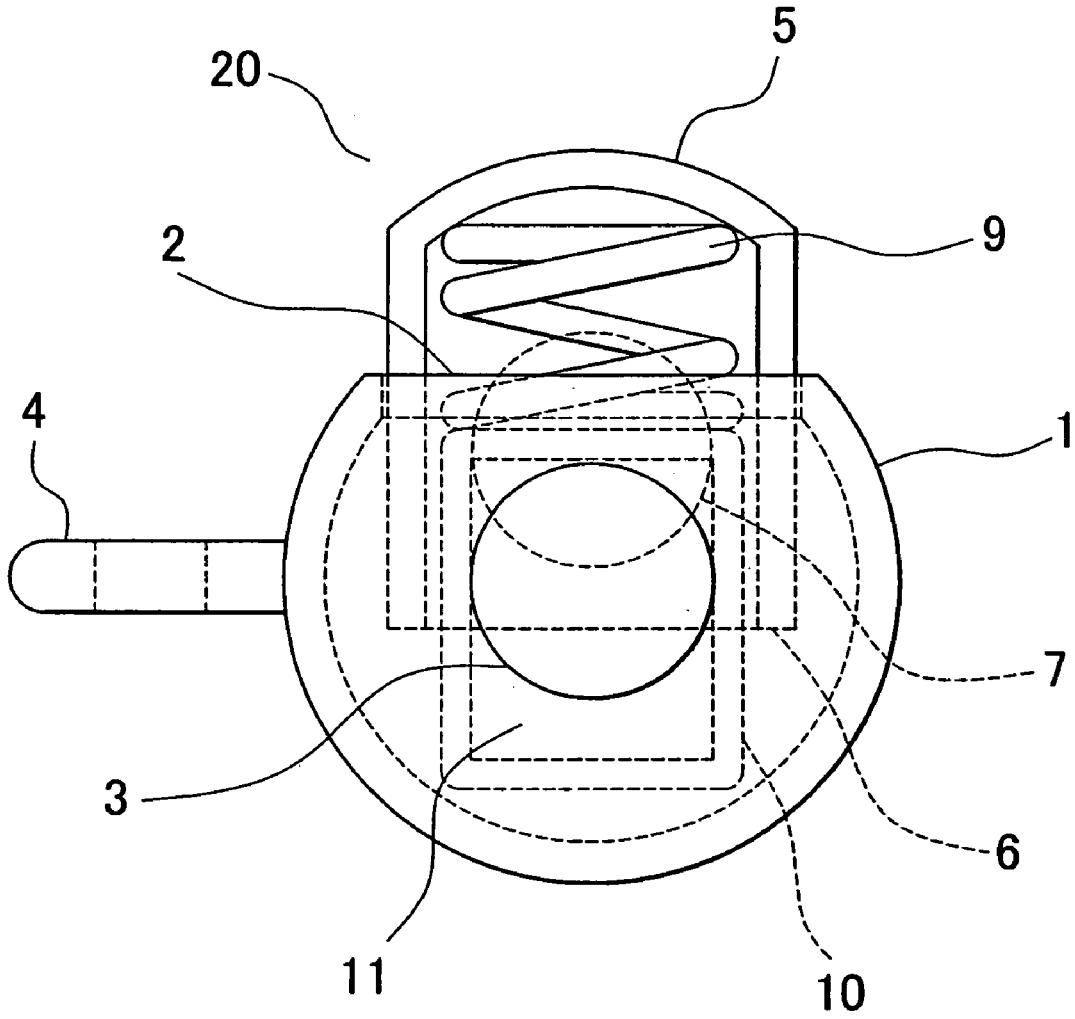
FIG. 3 is a front view showing assembly of the push type fitting of the present invention.
Figure 4:
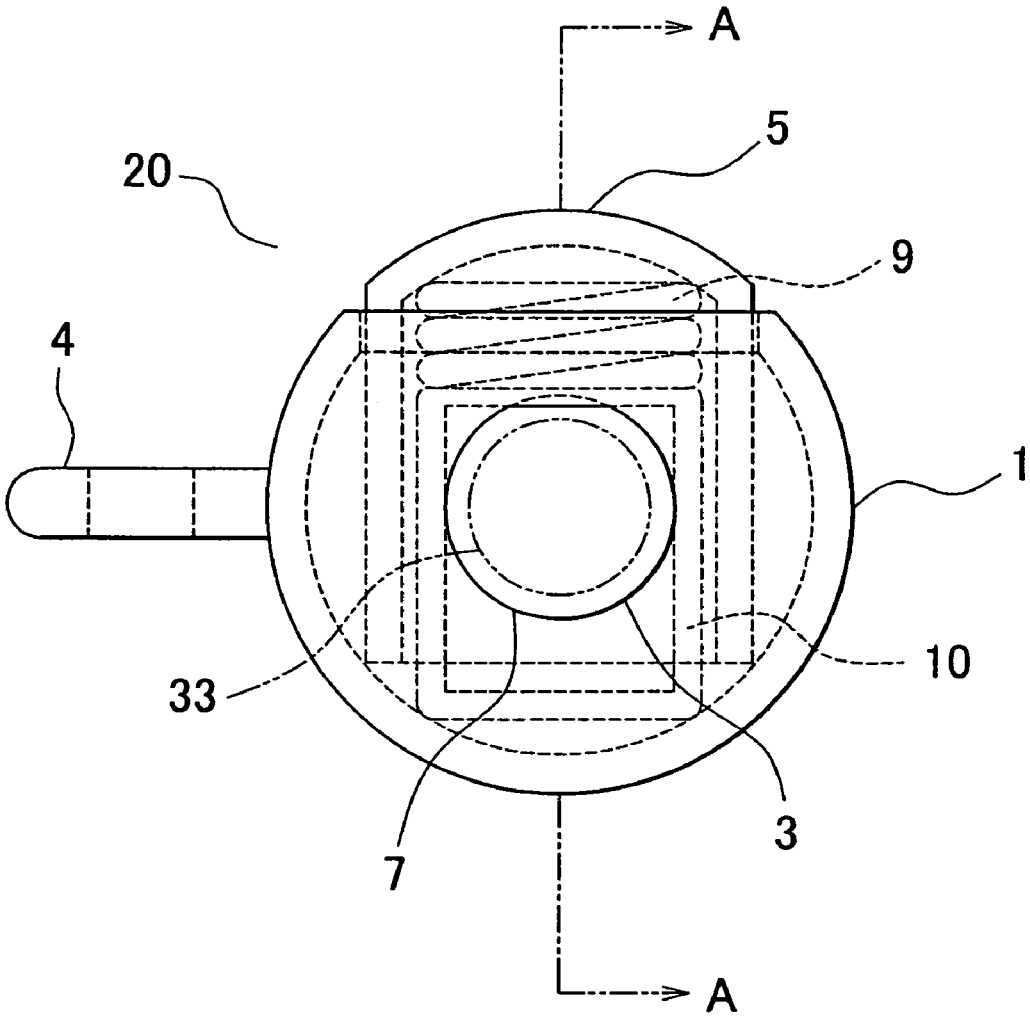
FIG. 4 is a front view showing a state in which a chain is inserted into the push type fitting of the present invention.
Figure 5:
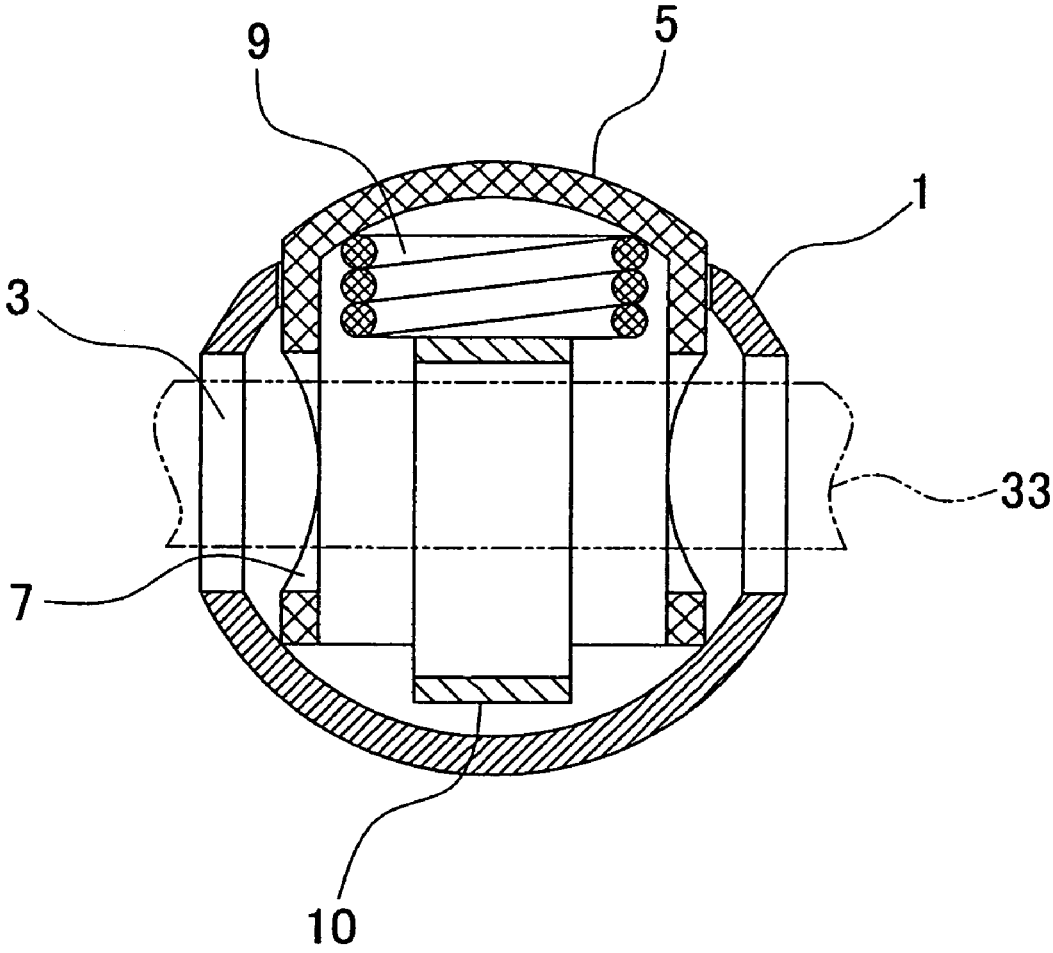
FIG. 5 is a sectional view taken along the line A—A in FIG. 4.
Figure 6:
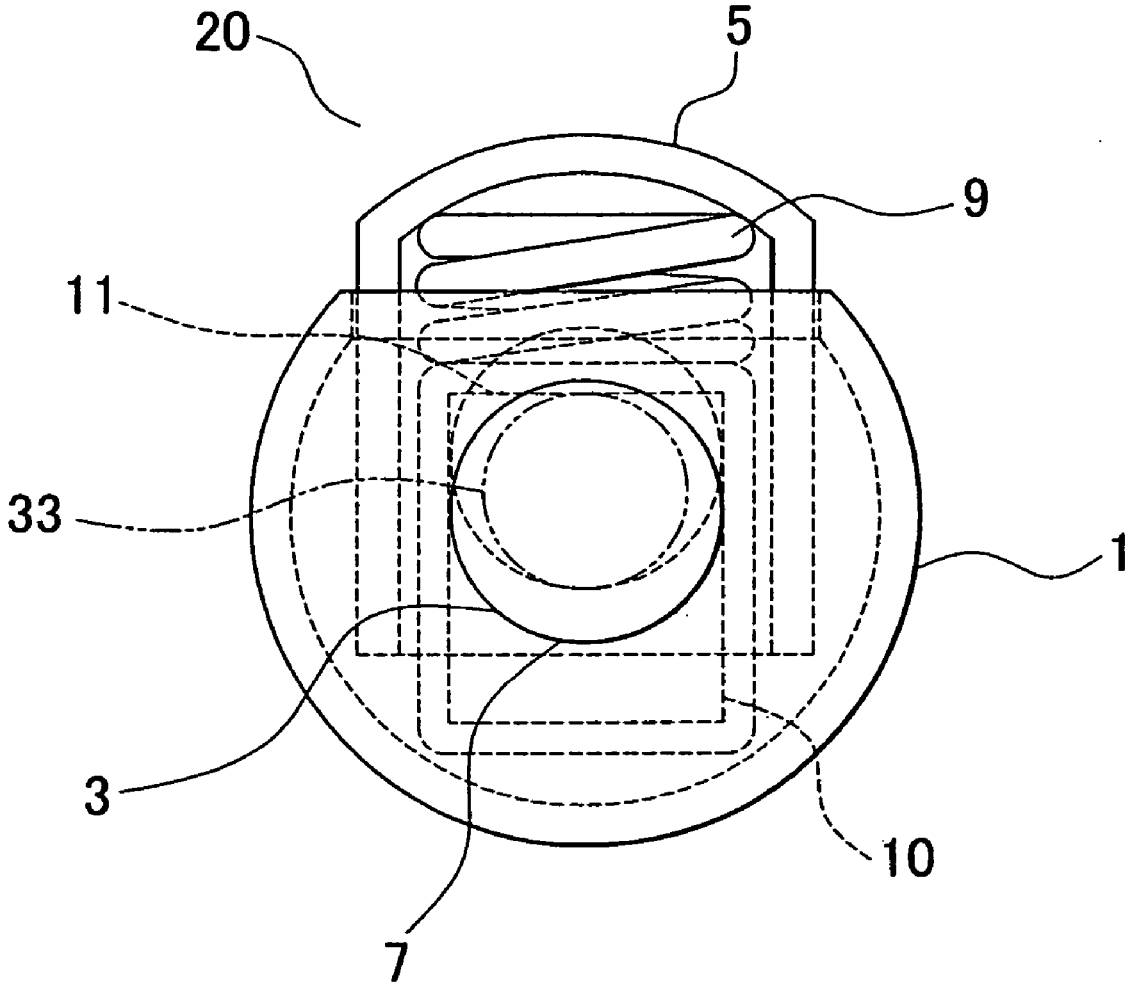
FIG. 6 is a front view showing a state in which the push type fitting catches the chain.
Figure 7:
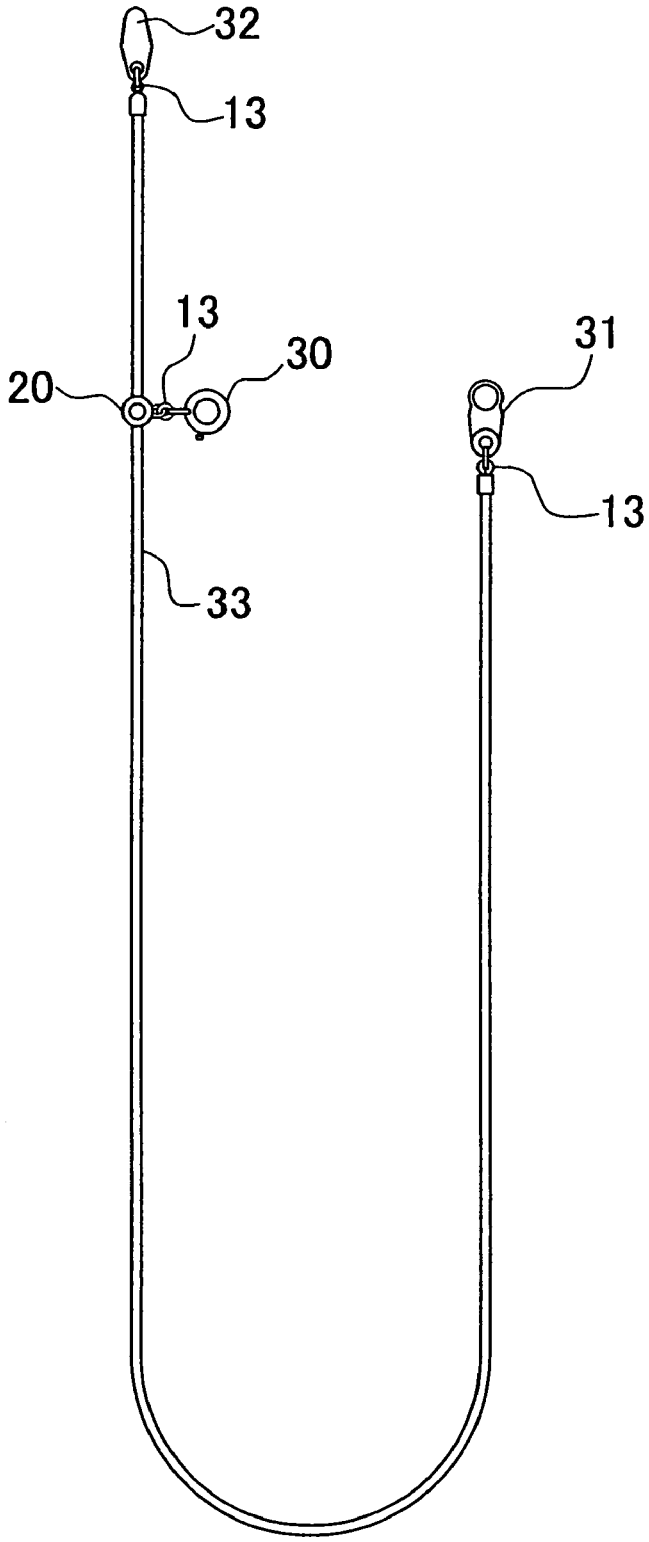
FIG. 7 is a general view showing a necklace using the push type fittings of the present invention.

FIG. 1 is a perspective view showing one use of a first embodiment of a push type fitting 20 of the present invention. FIGS. 2A, 2B, 2C and 2D are conceptual diagrams of component parts of the push type fittings 20. FIG. 3 shows the aforesaid components assembled. FIG. 4 is a front view showing a chain inserted into an aperture portion. FIG. 5 is a sectional view. FIG. 6 is a front view showing the aperture portion catching the chain. FIG. 7 is a view of a necklace using the push type fitting 20.

An embodiment of the present invention will be explained hereinafter based on the drawings. The push fitting 20 according to the present invention is constituted of a gold alloy or a white gold alloy that is precious metal, and is made by forming the precious metal. The push fitting 20 is constructed by four components, namely (A) an outer body 1, (B) an sliding body 5, (C) a coil spring 9 and (D) a ring body 10, as shown in the conceptual diagrams of the components in FIGS. 2A, 2B, 2C and 2D. The outer body 1 in FIG. 2A has an aperture portion 2 at an upper portion, a pair of insertion holes 3 opposing each other for passing a chain through on side surfaces perpendicular to the aforesaid aperture portion 2, and a ring 4 for connecting a clasp.

Figure 2A:
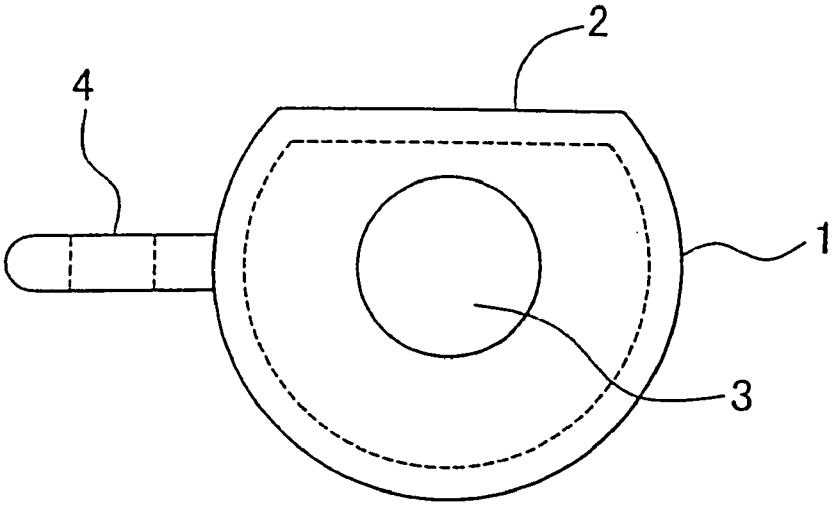
FIGS. 2A, 2B, 2C and 2D are conceptual diagrams showing respective components of the push type fitting of the present invention.
Figure 2B:
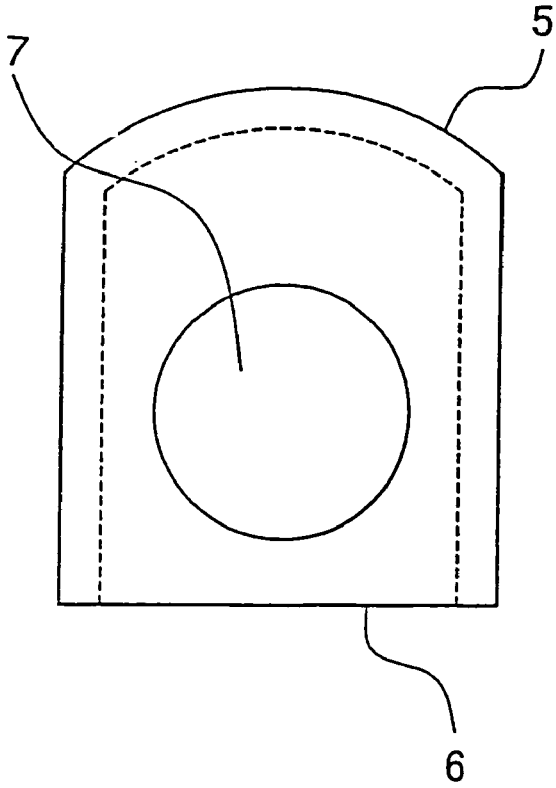

The sliding body 5 in FIG. 2B is tightly closed at one end and has an aperture portion 6 at the other end, and has a pair of through-holes 7 opposing each other, through which a chain is inserted, on the side surfaces perpendicular to the aperture portion 6.

Figure 2C:
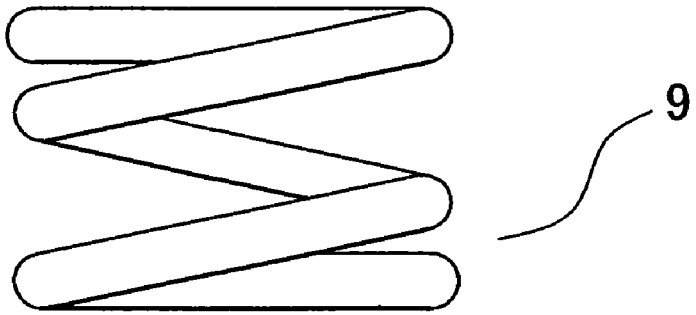

The coil spring in FIG. 2C functions to bias the through holes 7 of the sliding body 5 and an aperture portion 11 of the ring body 10 in a direction to catch a chain 33.

Figure 2D:
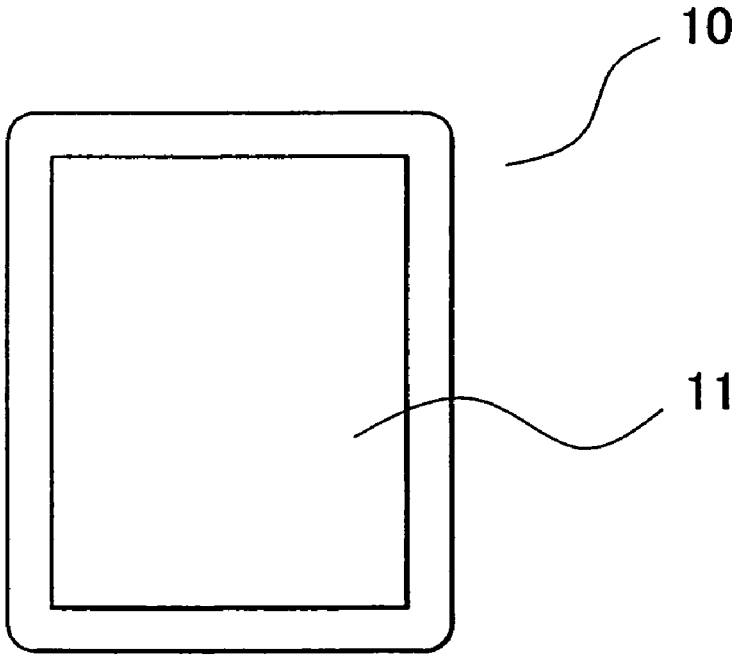

The ring body 10 in FIG. 2D forms approximately a rectangular or circular ring shape, and is provided with the penetrated aperture portion 11 through which the chain 33 is passed.

FIG. 3 shows that the push type fitting 20 is assembled by combining the components shown in FIGS. 2A to 2D. The coil spring 9 and the ring body 10 are placed inside the sliding body 5 in this order, and the sliding body 5 is inserted from the aperture 2 of the outer body 1, whereby the push type fitting 20 is assembled.

FIG. 4 shows a state in which the chain 33 is inserted into the push type fitting 20 constructed in FIG. 3. The push type fitting 20 is held nipped between a thumb and an index finger, and the sliding body 5 is pressed with the index finger, whereby the insertion holes 3 of the outer body 1 and the through holes 7 of the sliding body 5 are aligned with the aperture portion 11 of the ring body 10, and one end of the chain 33 is inserted through the insertion holes 3, the through holes 7 and the aperture portion 11.

FIG. 6 shows a state in which the chain 33 is caught. From FIG. 4, the index finger is removed from the sliding body 5 releasing it, whereby the sliding body 5 is pushed outward by the coil spring 9, and the insertion holes 7 and the aperture portion 11 are misaligned with each other to make it possible to catch the chain 33 with the through holes 7 of the sliding body and a plane of an inner surface portion of the aperture portion 11 of the ring body.

FIG. 7 is an overall view showing one embodiment using the push type fitting 20 of the present invention for a necklace. A decorative plate 32 prevents the fitting from slipping off of the chain is connected to the aforementioned one end of the chain 33 which is inserted through the fitting 20, and a clasp connecting plate 31 is connected to a tip end of the other side with a connecting ring 13. The ring of the necklace can be formed by connecting the clasp 30 and the connecting plate 31.

In order to change the length of the ring of the aforesaid necklace, the push type fitting 20 is held between the thumb and the index finger, as explained in reference to FIG. 4 and the sliding body 5 is pressed with the index finger, whereby the sliding body 5 can be slid. When the chain is to be fixed at an optional position, the index finger is removed from the sliding body 5 to release it, and thereby it can be stopped.

While presently preferred embodiments of the invention have been herein described, it is to be appreciated that various changes, rearrangements and modifications may be made therein without departing from the scope of the invention as defined by the appended claims.

What is claimed is:

1. A push type fitting capable of freely changing a length of a chain loop such as a necklace or a bracelet, said push type fitting comprising:

a hollow outer body having an aperture at one end and a pair of holes opposing each other in side surfaces of said body, said pair of holes being substantially perpendicular to said aperture, said pair of holes adapted for receiving the chain, and said body having a connecting ring;

a sliding body at least partly housed inside said outer body and movable up and down, said sliding body being closed at one end and having an aperture at the other end, and having a pair of through holes opposing each other on side surfaces of the sliding body substantially perpendicular to the aperture adapted for passing the chain there through;

a ring body housed inside said sliding body forming an approximately rectangular or circular ring shape, and having a penetrated aperture portion adapted for passing the chain there through; and a coil spring housed inside said sliding body, and biasing said sliding body and said ring body in a direction to catch the chain.

2. A push type fitting according to claim 1, wherein said outer body is replaceable.

3. A push type fitting according to claim 1 further comprising a clasp connected to said connecting ring.

4. A push type fitting for freely changing the length of a chain loop having a clasp connector at one end, the fitting comprising:

a hollow outer body having an aperture at one end and a pair of opposing holes in sidewalls substantially perpendicular to the outer body aperture;

a hollow sliding body partly extending into said outer body aperture and slideable in said outer body, said sliding body having a closed end, an aperture at the other end, sidewalls and a pair of opposing through holes in said sliding body sidewalls;

a ring body partly extending into and slideable within said sliding body;

a spring in said sliding body between said closed end and said ring body for biasing the ring body to catch the chain between the ring body and sliding body; and a clasp connected to said outer body adapted for connection to the clasp connector on the chain.

* * * * *